US005190288A

United States Patent [19]

Rogers

[11] Patent Number: 5,190,288

[45] Date of Patent: Mar. 2, 1993

[54] GOLF CLUB AND ATTACHABLE BALL RETRIEVER

[76] Inventor: Gordon Rogers, 23. Winwood, School Lane, Woolton, Liverpool 25, L25 7XJ, Merseyside, England

[21] Appl. No.: 811,256

[22] Filed: Dec. 19, 1991

[51] Int. Cl.[5] ..... A63B 53/00

[52] U.S. Cl. ..... 273/162 E; 294/19.2

[58] Field of Search ..... 273/162 E, 32 F, 32 H, 273/32 R, 32 B, 162 R, 162 F, 162 B; 294/19.2

[56] References Cited

U.S. PATENT DOCUMENTS 3,743,338 7/1973 Seeger ..... 294/19.2

FOREIGN PATENT DOCUMENTS 23966 of 1902 United Kingdom ..... 273/19.2

*Primary Examiner*—George J. Marlo

*Attorney, Agent, or Firm*—Rogers, Howell & Haferkamp

[57] ABSTRACT

The present invention relates to a ball retriever and more particularly, to an attachment for temporarily attaching to an end of an extension member, and the attachment while it is so attached to the extension member being used for retrieving a ball, such as a golf ball on the ground or the like. When not in use, this attachment lies at rest in a substantially flat condition, being conveniently sized to slip into a standard breast pocket or the like.

19 Claims, 1 Drawing Sheet

GOLF CLUB AND ATTACHABLE BALL RETRIEVER

BACKGROUND OF THE INVENTION (1) Field of the Invention

The present invention relates to a ball retriever for temporarily attaching to an end of a golf club handle and the ball retriever while it is so attached to the extension member being used for retrieving a ball, such as a golf ball. When not in use, this ball retriever lies at rest in a substantially flat condition, being conveniently sized to slip into a standard breast pocket or the like.

(2) Description of the Related Art

The variety of golf ball retrievers known in the prior art can be categorized under three types. The first type generally comprises a golf ball grasping tool united with one end of a shaft that in turn has for its opposite end a handle. The second type generally comprises an attachment which contains a golf ball grasping tool. The attachment is for temporarily fitting on the end of an extension member, such as the handle/grip of a golf club when a ball is to be retrieved. The third type generally comprises a unitary golf club having a golf ball grasping tool formed into its handle.

The present invention relates to an improvement over the second of the above-mentioned types. The known retrievers of the second type are generally disadvantaged in having too much bulk. The known retrievers are generally fabricated in accordance with fixed dimensions and are ready for use as fabricated. These known retrievers when not in use, are not provided with the facility for compacting down to a more convenient size for portability. Too much size means, for instance, that a person cannot carry one of these known retrievers in a breast pocket without at least being aware of its presence there. Indeed, for many persons, the experience of a bulky golf ball retriever stuffed into a breast pocket is an annoying experience.

Another disadvantage associated with these known retrievers involves their limited interchangeability with various sizes of golf club handles. This negative characteristic of limited interchangeability is also related to these retrievers being fabricated according to fixed dimensions. That is to say, since these known retrievers are fabricated in fixed sizes, they are sized for one particular, or perhaps a small range of, golf club handle diameters. Among the known retrievers, none are believed to have the ability to fit every size of golf club handle across the normal range of handle diameters that are commercially available.

What is needed to overcome these problems is an improved ball retriever that has fold out/fold in capability both for folding to a more compact size for more convenient carrying when not in use, and for folding out the ball retriever for use, while increasing the range of diameters over which the ball retriever can be temporarily fitted.

SUMMARY OF THE INVENTION

In accordance with the present invention, a golf ball retriever is provided for temporarily attaching to the end of an extension member usually the upper end of a golf club handle. While the ball retriever is so attached to the extension member, the ball retriever provides facility for retrieving a ball. The ball retriever generally comprises plates of resilient sheet material. These plates generally have coextensive opposite sides extending between opposite ends. There is adhesive tape which is used to join these plates together by wrapping the tape back and forth around the opposite sides of the plates. The tape joins the plates in a flexible relation such that their respective sides are hinged together.

The plates normally lie flat, but yet will bend arcuately, or bow, when the sides are pressed together so that they will define a longitudinal tube with open ends.

There is also a stop secured to the inner surfaces of the plates that lies flat when the plates are lying flat. Yet the stop will extend across the tube when the plates are squeezed into a tube, hence providing a stop surface within the tube at a longitudinal station midway between the tube ends.

One of the tube ends is sized to permit the insertion therethrough of the end of a golf club handle. The golf club handle can be within a range of diameters. The other open tube end is sized for grasping the ball. The inherent resiliency of the plates provides for the resiliently biased gripping of the golf club handle and further provides for the resiliently biased releasable grasping of the ball to be retrieved.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
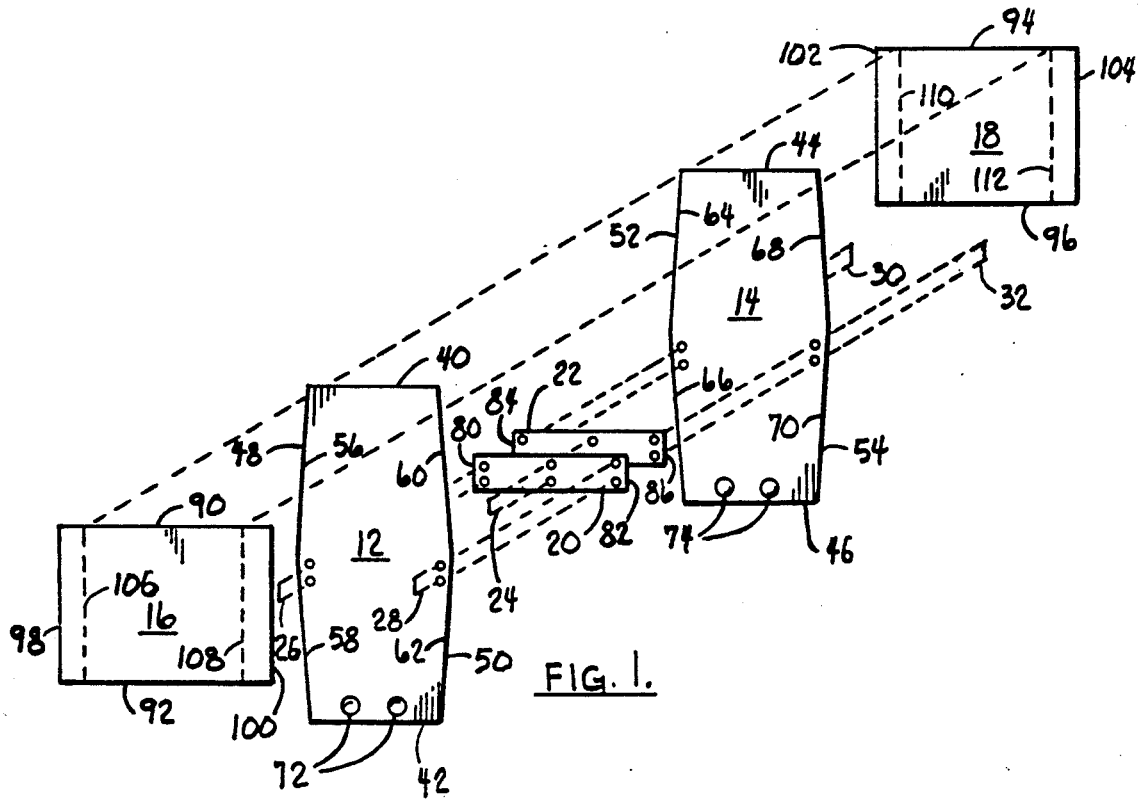
FIG. 1 is an exploded, front elevation view of the ball retriever of the present invention.

With reference to FIG. 1, the ball retriever 10 of the present invention is shown comprising opposite plates 12 and 14, opposite portions of adhesive tape 16 and 18, opposite strips 20 and 22, a staple 24 for centrally securing the opposite strips 20 and 22 together, and four staples 26, 28, 30 and 32 for securing the strips 20 and 22 to the plates 12 and 14 in a manner to be described more particularly below.

The plates 12 and 14 are generally made of a flexible and resilient material which may be plastic or the like. The plates 12 and 14 are generally the same size and have longitudinally spaced proximal and distal end edges 40 and 42, 44 and 46 extending between laterally spaced side edges 48 and 50, 52 and 54. The side edges 48 and 50 have inwardly extending margins along proximal and distal segments 56 and 58, 60 and 62 respectively. Likewise, the side edges 52 and 54 have inwardly extending margins along proximal and distal segments 64 and 66, and 68 and 70 respectively. The distal end edge 42 of plate 12 is formed with indentations 72. Likewise, the distal end edge 46 of plate 14 is formed with indentations 74.

The strips 20 and 22 are made of a flexible material such as plastic or the like. The strips 20 and 22 have ends 80 and 82, 84 and 86 respectively. As previously indicated, the strips 20 and 22 are centrally secured to each other by the staple 24. The end 80 of the strip 20 is secured to the plate 12 midway along side 48 by the staple 26. In like fashion, the end 82 of the strip 20 is secured to the plate 12 midway along side 50 by the staple 28. Likewise, the end 84 of the strip 22 is secured to the plate 14 midway along the side 52 by the staple 30. And finally, the end 86 of the strip 22 is secured to the plate 14 midway along the side 54 by the staple 32.

Figure 2:
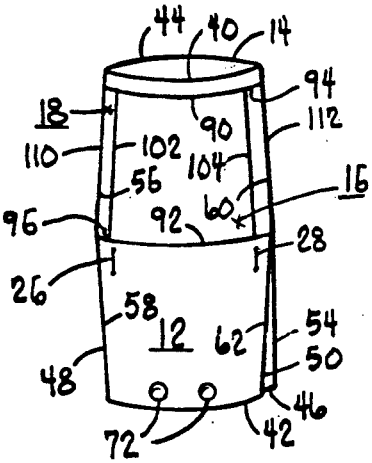
FIG. 2 is a perspective view of the ball retriever of the present invention, as assembled, and as lying generally flat as when not in use.

The tape portions 16 and 18 have transversely spaced edges 90 and 92, 94 and 96 respectively, extending between spaced apart, opposite cut-off ends 98 and 100, 102 and 104 respectively. The tape portion 16 is generally applied to the outwardly facing surface of the plate 12 (as illustrated in FIG. 2) with the transverse edge 90 located just inwardly of the proximal end edge 40. The other transverse edge 92 is located just shy of the midpoint between the proximal and distal end edges 40 and 42 of the plate 12 (as illustrated in FIG. 2). The tape portion 16, as applied to the plate 12, is laterally wider than the lateral extent of the plate 12. In consequence, the tape portion 16 has laterally spaced excess margins 106 and 108. These excess margins 106 and 108 of the tape portion 16 are wrapped around all four side edges of the plates 12 and 14, that is, the side edges 48, 50, 52 and 54, and from there over the outwardly facing surface of the plate 14 (not illustrated).

The tape portion 18 is adhesively applied to the plates 14 and 12 in a manner that is nearly a mirror image of what has been described above. The tape portion 18, like the tape portion 16, has laterally spaced excess margins 110 and 112. As can be seen in FIG. 2, the excess edge margins 110 and 112 of the tape portion 18 extend over the outwardly facing surface of the plate 12, to be adhered to the non-sticky side of the tape portion 16 as illustrated.

Figure 3:
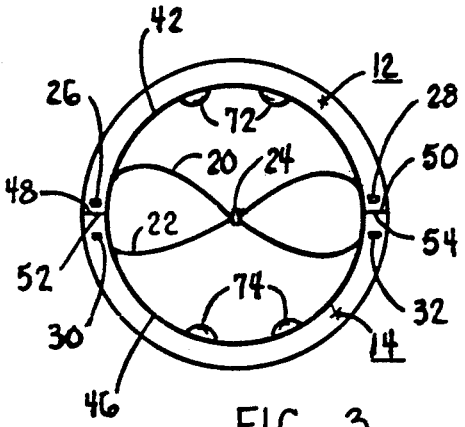
FIG. 3 is an enlarged view of one end of the ball retriever of the present invention, as when flexed into a tube configuration as when in use.
Figure 4:
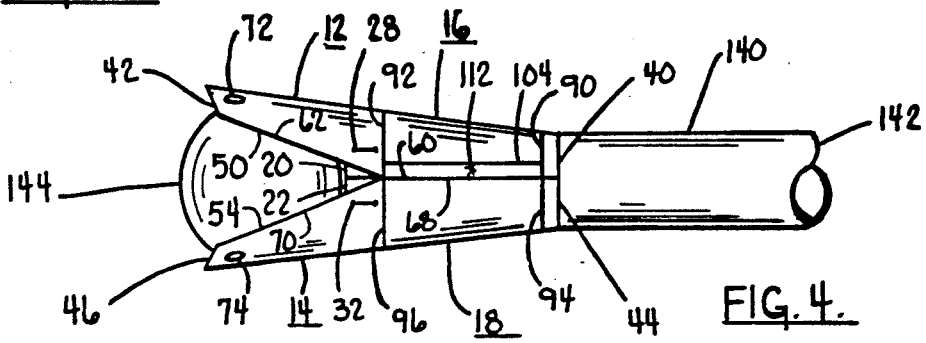
FIG. 4 is a side elevation view with the ball retriever of FIG. 2 rotated 90°, with a ball and portions of the end of an extension member shown to illustrate the use of the present invention therewith.

Accordingly, the tape portions 16 and 18 secure the plates 12 and 14 together in a flexible relation such that the margin segment 56 of the plate 12 is movable in relation to the margin segment 64 of the plate 14 in a hinge-like fashion. Likewise, the margin segment 60 of plate 12 is movable in relation to the margin segment 68 of the plate 14 in a similar hinge-like fashion. As seen in FIG. 2, the plates 12 and 14 lie at rest, or unflexed, in a generally flat condition when both pairs of adjacent margin segments 56 and 64, 60 and 68 respectively are swung closed. On the other hand, as illustrated in FIG. 3, the plates 12 and 14 can be bent arcuately between their margin segments 56 and 60, 64 and 68 respectively, when both pairs of adjacent margins 56 and 64, 60 and 68 are swung open—such that the plates 12 and 14 define a longitudinal tube while at the same time the end edges 40 and 44, 42 and 46 respectively co-define one of two, opposite open tube ends. The strips 20 and 22 are secured to the plates 12 and 14 in a manner that has the strips 20 and 22 lying flat between the plates 12 and 14 when the plates 12 and 14 themselves are lying flat, as illustrated in FIG. 2. Yet when the plates 12 and 14 are arcuately bent into a tube, as illustrated in FIG. 3, the strips 20 and 22 fold out to define a stop surface within the tube at a longitudinal station midway between the tube ends, as generally illustrated in FIGS. 3 and 4. With more particular reference to FIG. 4 now, the tube end defined by the proximal end edges 40 and 44 is sized to permit therethrough the insertion of an end 140 of an extension member 142, typically a golf club handle, as illustrated. The insertion of that extension member 142 is stopped by the obstruction that is presented in the form of the strips 20 and 22, which fold out as described above. The tube end that is defined by the distal end edges 42 and 46, is sized for grasping a ball 144 as illustrated.

The inherent flexibility of the plates 12 and 14 provide for the flexibly arcuate bending of the plates 12 and 14 into a tube as illustrated in FIG. 3. The plates 12 and 14 may be manually flexed by gently squeezing the margin segment pair 56 and 64 in the direction of margin segment pair 60 and 68, from an originally flat condition as illustrated in FIG. 2 to a tube-like condition as illustrated in FIG. 3.

The inherent resiliency of the material of the plates 12 and 14 provides for the resiliently biased gripping of the extension member 142 between the plates 12 and 14 as illustrated in FIG. 4. Likewise, the same inherent resiliency of the plates 12 and 14 provides for the resiliently biased releasable grasping of the ball 144, as illustrated in FIG. 4.

It is furthermore shown in FIG. 4 that the distal halves of plates 12 and 14 can function like opposite jaw parts, which means that they have a limited ability to spread jaw-like apart for resiliently biting the ball 144 as illustrated in FIG. 4.

The indentations 72 and 74 are shown to assist the retention of the ball 144 while it is releasably grasped between the plates 12 and 14 as illustrated in FIG. 4.

While the present invention has been described by reference to a specific embodiment, it should be understood that modifications and variations of the invention may be constructed without departing from the scope of the invention defined in the following claim.

We claim:

1. An attachment for temporarily attaching to the end of an extension member, the attachment when so attached being used for retrieving a ball, the attachment comprising:

opposite plates of flexible sheet material having generally coextensive laterally spaced side borders extending between longitudinally spaced end edges;

joining means for joining said plates such that the side borders of one plate cooperate with the respectively adjacent side borders of the other plate in hinge-like fashion;

said plates lying generally flat when both pairs of adjacent side borders are spread apart, and said plates both bowing between their side borders when the side borders are pressed toward one another to define a longitudinal tube while the end edges define opposite open tube ends;

one of said open tube ends being sized to permit the insertion therethrough of the end of the extension member, and the other open tube end being sized for grasping the ball; and resiliency mean united with said plates normally biasing said plates to lie generally flat and for yielding to pressure, applied to squeeze said sides toward one another thereby providing for the resiliently biased gripping of said extension member therebetween, while further providing for the resiliently biased releasable grasping of the ball to be retrieved.

2. The attachment of claim 1 wherein:

said portions are independent members.

3. The attachment of claim 1 wherein:

the resiliency means comprises the inherent resiliency of the sheet material.

4. The attachment of claim 1 wherein:

the joining means is adhesive tape.

5. The attachment of claim 4 wherein:

the adhesive tape is wound around the outer surfaces and extremities of the two portions in a longitudinal swathe, laterally around the opposite sides.

6. The attachment of claim 5 wherein:

the tape has spaced apart transverse edges that, when adhered to the portions, longitudinally extend between a first and a second longitudinal station;

first longitudinal station is proximate to the end edges which define the open tube that receives the extension member end; and the second longitudinal station is proximate to a midpoint between the end edges;

whereby said tube comprises two jaw parts separated by a pair of circumferentially spaced slits defined between the side borders beginning at about said midpoint and extending through the ball retriever tube end, said jaw parts being separable for resiliently biting the ball to be retrieved.

7. The attachment of claim 1 wherein:

each portion further comprises indentations spaced just inwardly from the end edge which co-defines the open tube end that grasps the ball to be retrieved, said indentations for assisting the retention of the ball.

8. The attachment of claim 1 further comprising:

stop means secured by said portions for lying flat between said portions when said portions define a flat piece, and for folding out when said portions define a tube, hence providing a stop surface within the tube at a longitudinal station midway between the tube ends.

9. The attachment of claim 8 wherein:

the stop means comprises a pair of cooperating strips of flexible material, each with spaced apart opposite ends, such that the strips are centrally secured to each other, and each of the four strip ends are secured to a respectively different margin of said portions in the proximity of a mid-point between the end edges.

10. The attachment of claim 9 wherein:

the strips are generally the same size.

11. A ball retriever which, while temporarily fitted to the handle end of a gold club shaft, provides for the releasable retrieving of a ball, the retriever comprising:

a pair of flexible plates having generally coextensive laterally spaced opposite sides extending between longitudinally spaced ends;

joining means for joining the plates together for hinged movement; and the plates being of resilient material biasing them toward normally flat configurations;

the plates being deflectable against said resilient bias to a tube-like configuration that has opposite open tube ends, wherein one of the two tube ends is for receiving the golf club shaft and gripping it under the action of said resilient bias, while the other tube end is for receiving and gripping the ball to be retrieved under the action of said resilient bias.

12. The retriever of claim 11 wherein:

the joining means is adhesive tape.

13. The retriever of claim 12 wherein:

the adhesive tape is wound around the outer surfaces and sides of the two plates.

14. The retriever of claim 13 wherein:

the tape has spaced apart transverse edges that, when adhered to the plates, longitudinally extend between a first and a second longitudinal station;

the first longitudinal station is proximate to the plate ends which defined the tube end that receives the extension member; and the second longitudinal station is proximate to a midpoint between the plate ends;

thus the tube comprises two jaw parts separated by a pair of circumferentially spaced slits defined between the sides beginning at about said mid-point and extending through the ball retriever tube end, said jaw parts are limitedly able to spread apart for resiliently biting the ball to be retrieved.

15. The retriever of claim 11 wherein:

an obstruction means compromises a pair of cooperating strips of flexible material, each with spaced apart opposite ends, such that the strips are centrally secured to each other, and each of the four strip ends are secured to a respectively different plate side in the proximity of a mid-point between the plate ends to thereby act as stops against the end of the golf club shaft and against the ball.

16. The retriever of claim 15 wherein:

the strips are generally the same size.

17. The retriever of claim 11 wherein:

each plate further comprises indentations spaced just inwardly from the plate end which co-defines the ball retriever tube end, said indentations assisting the retention of the ball.

18. The retriever of claim 11 further comprising:

an obstruction means held between the plates intermediate the ends of the plates and in a substantially flat condition when the plates are in their normal flat configurations and for being extended between opposite sides of the tube when the plates are in their tube-like configuration for thereby limiting the passage of the golf club shaft therethrough.

19. The ball retriever of claim 11 wherein said one of said tube ends is in gripping engagement with a gold club shaft.

* * * * *